US006113358A

United States Patent [19]

Young et al.

[11] Patent Number: 6,113,358

[45] Date of Patent: Sep. 5, 2000

[54] SCROLL COMPRESSORS

[75] Inventors: Terence William Thomas Young, Gravesend; John Michael Roll, Fawkham, both of United Kingdom

[73] Assignee: AAF - McQuay Inc., Baltimore, Md.

[21] Appl. No.: 09/068,128

[22] PCT Filed: Nov. 1, 1996

[86] PCT No.: PCT/GB96/02679

§ 371 Date: May 1, 1998

§ 102(e) Date: May 1, 1998

[87] PCT Pub. No.: WO97/16649

PCT Pub. Date: May 9, 1997

[30] Foreign Application Priority Data

| | | | |
|---|---|---|---|
| Nov. 2, 1995 | [GB] | United Kingdom | 9522516 |
| Nov. 2, 1995 | [GB] | United Kingdom | 9522517 |
| May 30, 1996 | [GB] | United Kingdom | 9611261 |

[51] Int. Cl.[7] ..... F01C 1/02; F04B 3/00

[52] U.S. Cl. ..... 417/250; 418/15; 418/55.1; 418/5

[58] Field of Search ..... 417/250; 418/15, 418/55.1, 5

[56] References Cited

U.S. PATENT DOCUMENTS

| | | | |
|---|---|---|---|
| 4,611,975 | 9/1986 | Blain | 418/5 |
| 4,650,405 | 3/1987 | Iwanami et al. | 418/5 |
| 4,696,627 | 9/1987 | Asano et al. | 418/15 |
| 4,714,415 | 12/1987 | Mizuno et al. | 418/14 |
| 5,004,407 | 4/1991 | Hutchison | 418/1 |
| 5,304,047 | 4/1994 | Shibamoto | 418/5 |
| 5,501,584 | 3/1996 | Yamamoto et al. | 418/15 |
| 5,542,828 | 8/1996 | Grenci et al. | 418/1 |
| 5,839,886 | 11/1998 | Shaw | 417/250 |

FOREIGN PATENT DOCUMENTS

| | | |
|---|---|---|
| 3 626 796 | 3/1987 | Germany . |
| 58-124084 | 7/1983 | Japan . |
| 1 501 474 | 2/1978 | United Kingdom . |
| 2 116 635 | 9/1983 | United Kingdom . |

*Primary Examiner*—Charles G. Freay
*Assistant Examiner*—Robert Z. Evora
*Attorney, Agent, or Firm*—Howson and Howan

[57] ABSTRACT

A method of improving the efficiency of a pair of first and second scroll refrigeration compressors, at least the second of which includes an intermediate port is characterized in that the delivery of the first scroll compressor is fed into the intermediate port of the second compressor at a pressure corresponding to the intermediate port in the compression process occurring in the second scroll compressor.

10 Claims, 5 Drawing Sheets

SCROLL COMPRESSORS

CROSS REFERENCE TO RELATED APPLICATION

This application is a 371 of International Application No. PCT/GB96/02679 filed on Nov. 1, 1996.

TECHNICAL FIELD

This invention relates to a gas compressor of the kind using two intermeshed involute scrolls one of which remains stationary and the and the other of which orbits (but does not rotate) about the first scroll. By appropriate sizing of the scrolls and proper movement of one relative to the other, two gas chambers are first opened on diametrically opposite sides of the intermeshed scrolls, these chambers then grow in size until they are closed as "C" shaped pumping chambers which progress symmetrically on diametrically opposite sides of the center of the stationary scroll towards that center reducing in volume as they so progress. On reaching the center, the gas trapped in each chamber when it first closed, has been compressed to a higher pressure and is released from the chamber to the exhaust duct of the compressor. A compressor of this type will herein be referred to as a "scroll compressor" and a pair of gas chambers of one or more scroll compressors ganged together as described in the following paragraph will be referred to as "a scroll compressor arrangement of the kind specified".

For operating a scroll compressor in accordance with the method of this invention it is necessary for the compressor to have at least two "C"-shaped pumping chambers of variable volume, each of which receives fluid to be compressed from a primary inlet when the respective pumping chamber has a first volume at least close to its maximum volume and each of which discharges compressed fluid from an outlet when the respective pumping chamber has a second volume which is less than said first volume, one of said pumping chambers having a secondary inlet open to the said one chamber when it has a third volume intermediate the first and second volumes after said chamber is closed off from its primary inlet but before the said one chamber opens to its outlet.

The invention seeks to improve the efficiency of a scroll compressor arrangement of the kind specified particularly in its application to refrigeration.

The method of the invention may be practiced using two separate scroll compressors one of which provides the first "C"-shaped pumping chamber and the other compressor of which provides the second "C"-shaped pumping chamber. The invention may also be applied to a composite compressor arrangement where the at least two "C"-shaped chambers of varying volume are provided in a common casing.

DISCUSSION OF PRIOR ART

It is known to improve the efficiency of a compression refrigeration system if refrigerant gas is also allowed to enter a pumping chamber via an intermediate port (sometimes called herein an "economiser port"). As the economiser port is open to an intermediate stage of the compression process, for gas to enter the economiser port it must be at a higher pressure than the suction pressure. This is traditionally achieved by the use of an economiser vessel/heat exchanger and its associated control valves and pipework.

The operating principle behind the use of an economiser vessel/heat exchanger (sometimes referred to as "superfeed") is that liquid refrigerant is boiled off in the economiser vessel or heat exchanger at a pressure lower than the delivery pressure but higher than the suction pressure. The gas evolved from the vessel or heat exchanger is returned to the economiser port of the compressor arrangement whilst the liquid subcooled in the economiser vessel is led to the suction evaporator. This liquid subcooling increases the refrigeration capacity of the system. In addition, as the vapor evolved in the economiser vessel or heat exchanger is returned to the compressor arrangement at an intermediate pressure, less power is required to compress this vapor than if it were returned to the compressor arrangement at the suction pressure, thus effecting further economies.

SUMMARY OF THE INVENTION

According to one aspect of this invention a method of operating a scroll compressor arrangement of the kind specified is characterized in that the outlet of the other pumping chamber is fed to the secondary inlet of said one pumping chamber.

Effectively, therefore, this aspect of the invention can be seen as a way of utilizing a prior art economiser port of one of a pair of pumping chambers to improve performance without the need for any economiser vessel or system-derived side load.

The secondary inlet need not be in a fixed position in the said one pumping chamber and both pumping chambers in a scroll compressor arrangement of the kind specified can have such secondary inlets.

According to a further aspect of the invention a method of improving the efficiency of a pair of scroll refrigeration compressors at least one of which includes an intermediate port, involves the connection of the first compressor delivery into the intermediate port of the second scroll compressor. In this manner, the delivery pressure of the first scroll compressor is reduced to the intermediate pressure of the second scroll compressor so that the operational pressure ratio of the first scroll compressor is reduced with resulting improvements in both volumetric and isentropic efficiency. At the same time, refrigerant gas is entered into the second scroll compressor, via the intermediate port, during the compression of the low pressure suction gas in the second scroll compressor.

The invention is expected to offer advantages even over a conventional two-stage system. For a conventional two-stage system to operate efficiently there must be a considerable difference in the swept volumes of the two stages unless there is a considerable system side load. In the arrangement possible by practicing the method of the invention, both scroll compressors may be (but by the same token, if preferred, need not be) of the same swept volume. Thus a more flexible installation may be designed, with the option of shutting down one scroll compressor completely is system demand falls below 50% (in a two-compressor installation). In addition an alternating lead and lag compressor sequence may be operated if required. Furthermore the total compressor displacement required is greatly reduced when compared to a conventional two-stage system.

The system may be further refined by the use of an economiser facility (e.g. with a conventional economiser vessel or heat exchanger). Greater performance can be achieved in this mode.

BRIEF DESCRIPTION OF THE DRAWINGS

The invention will now be further described, by way of example, with reference to the accompany drawings, in which.

DESCRIPTION OF PREFERRED EMBODIMENTS

Although this invention relates solely to scroll compressors, FIGS. 1 to 4 illustrate piston-in-cylinder pumping chambers for easier understanding of the inventive concept.

Figure 1:
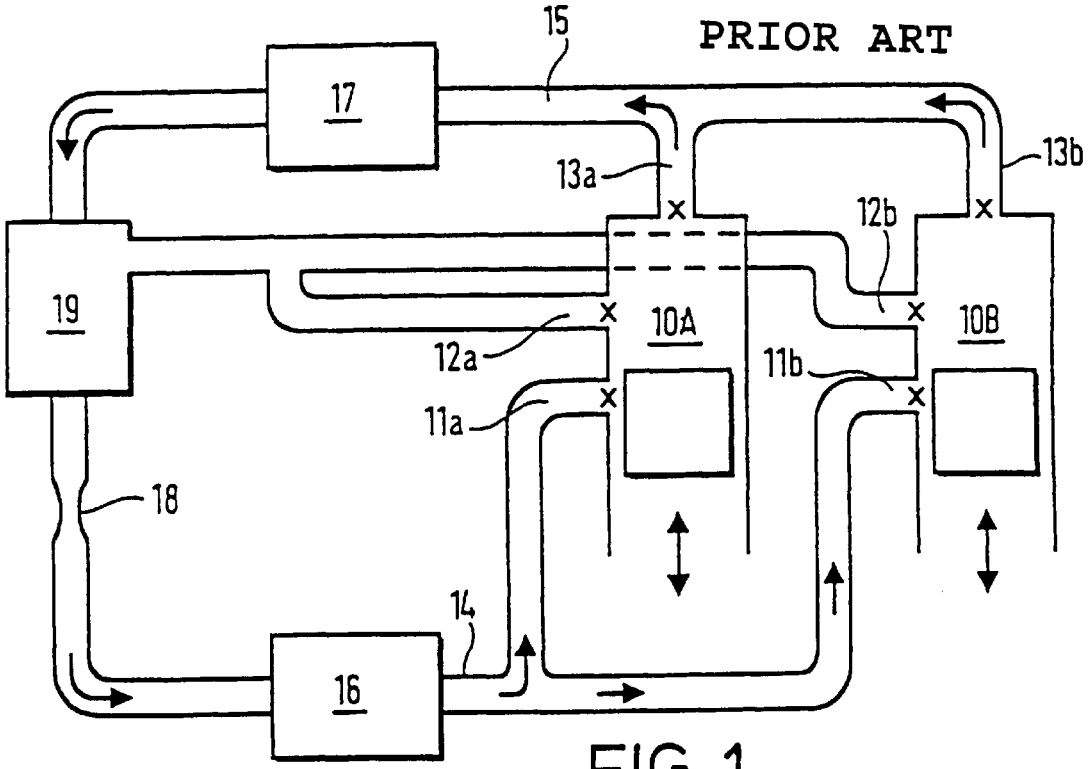
FIG. 1 shows, schematically, a compressor arrangement operating in conventional economiser manner.

FIG. 1 shows a prior art refrigeration multi-compressor system having two compressors with pumping chambers 10A and 10B, respectively, each having a primary inlet 11*a,* 11*b,* a secondary inlet (or economiser port) 12*a,* 12*b* and an outlet 13*a,* 13*b.* In conventional manner, the two primary inlets communicate with a common suction line 14 leading from the evaporator 16 of the system and the two outlets communicate with a common high pressure delivery line 15 leading to the upstream end of the condenser 17 of the system. The expansion valve is shown at 18. For economiser operation the intermediate ports 12*a* and 12*b* are connected to a vapor outlet 19*a* of an economiser vessel 19.

Figure 2:
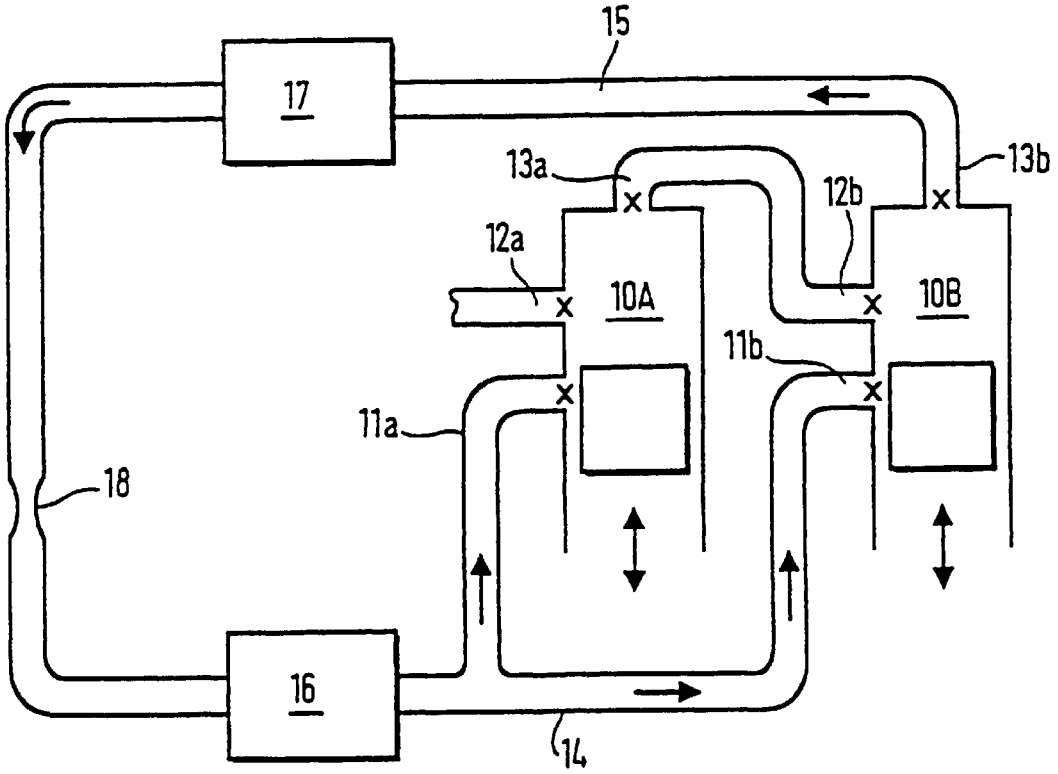
FIG. 2 shows the compressor arrangement of FIG. 1 connected to operate in accordance with the method of the invention without an economiser vessel.

FIG. 2 shows a compressor arrangement in accordance with the invention. The outlet 13*a* of chamber 10A is now connected to the intermediate inlet 12*b* of chamber 10B. Both inlets 11*a* and 11*b* remain connected to a common suction line 14 but only outlet 13*b* now feeds the delivery line 15. In its simplest form the intermediate port 12*a* is not used and this is the arrangement shown in FIG. 2.

Figure 3:
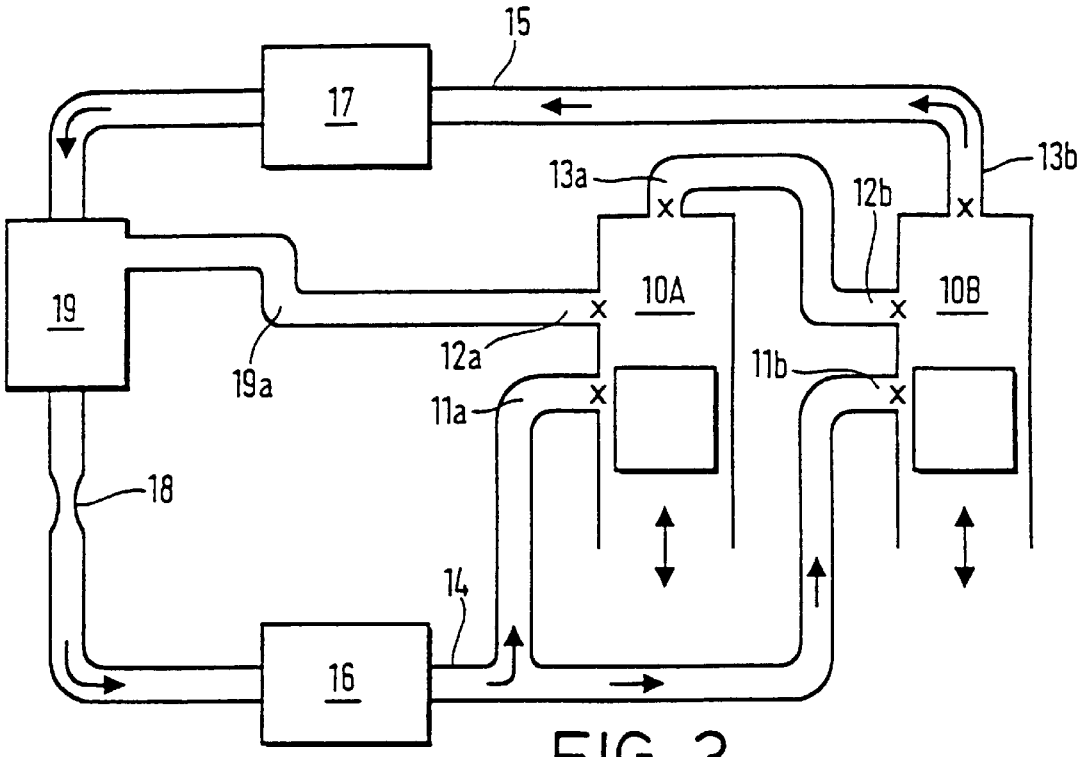
FIG. 3 shows the compressor arrangement of FIG. 1 connected to operate in accordance with the method of the invention with an economiser vessel connected to one of the pumping chambers.

FIG. 3 shows a further compressor arrangement connected in accordance with the invention but with the addition of an economiser vessel 19. The vapor outlet 19*a* from this economiser vessel is returned to the intermediate port 12*a.*

Figure 4:
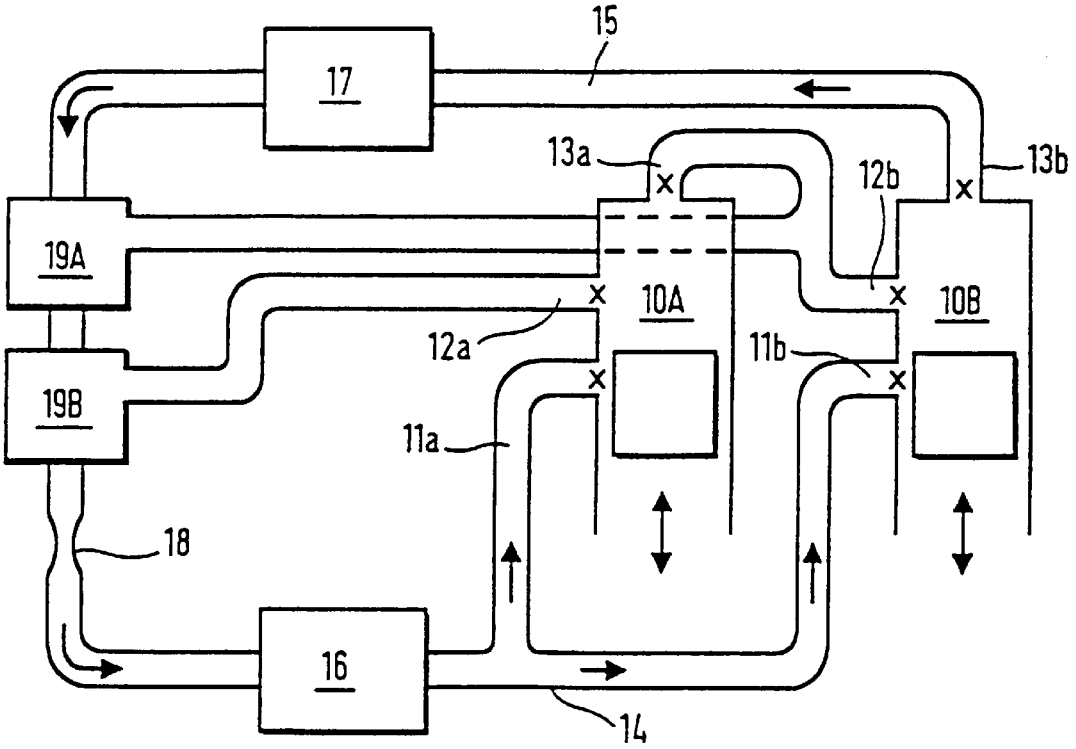
FIG. 4 shows the compressor arrangement of FIG. 3 further modified to utilize two economiser vessels connected in series.

FIG. 4 shows a still further compressor arrangement connected in accordance with the invention but now with two economiser vessels 19A, 19B connected. The vapor outlet from the first economiser vessel 19A, operating at the higher saturation pressure, is returned to the intermediate port 12*b,* where it mixes with the flow from the discharge port 13*a* as it enters chamber 10B. The vapor outlet from the second economiser vessel 19B is returned to the intermediate port 12*a* and flows into chamber 10A.

Unloading of the compressors 10A, 10B shown schematically in FIGS. 2, 3 and 4 can be undertaken in the normal way except that it is anticipated that the compression process in chamber 10A, pumping into the economiser port 12*b,* would be unloaded before the compression process in chamber 10B.

Figure 6:
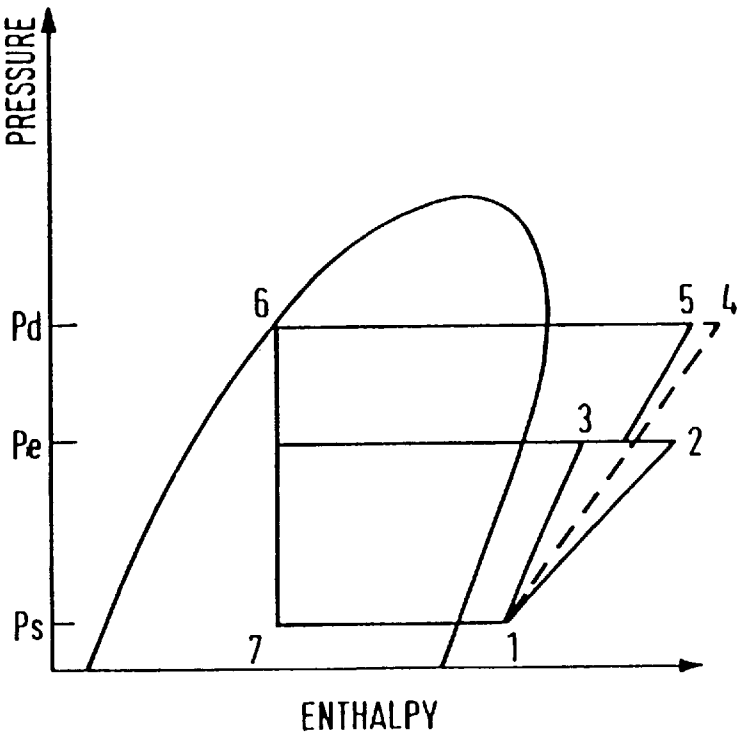
FIGS. 5 to 8 are graphs showing respectively pressure/enthalpy diagrams for the arrangements shown in FIGS. 1 to 4.
Figure 5:
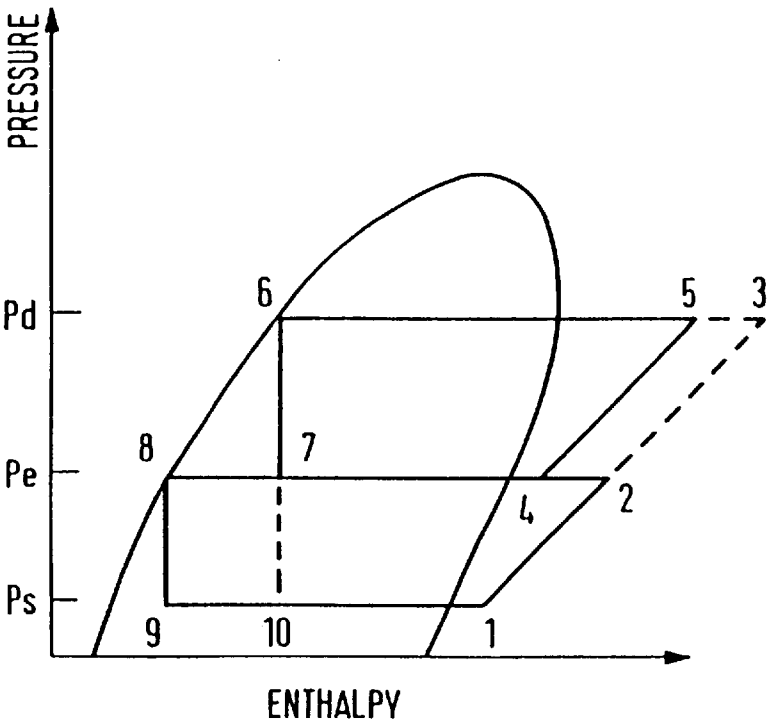
Figure 8:
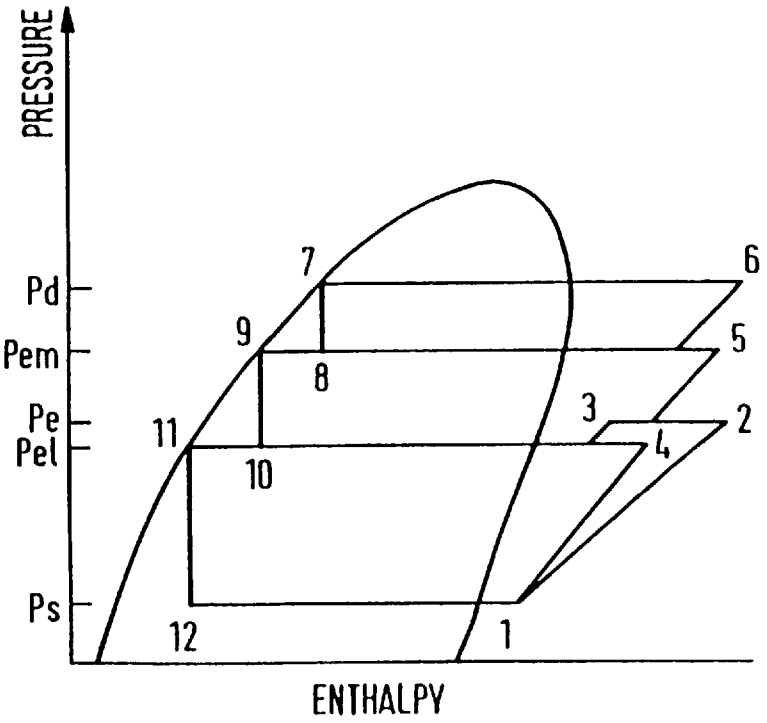
Figure 7:
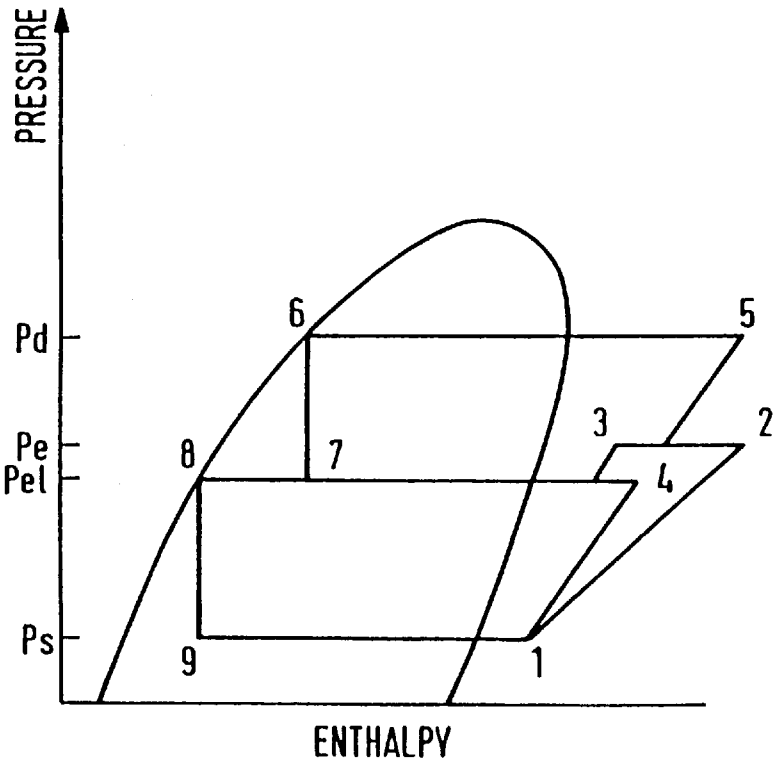

The pressure enthalpy diagrams shown in FIGS. 5 to 8 represent various refrigeration cycles starting with standard economised in FIG. 5 and continuing with systems designed in the manner of the invention in FIGS. 6, 7 and 8.

FIG. 5 shows the diagram for a standard economised scroll compressor machine. Starting at point 1, compression of a non-economised machine would normally progress along line 1–3, but when economiser flow is introduced at an intermediate pressure Pe then, provided the temperature of this gas from the economiser vessel is lower than the temperature of the gas in the "C"-shaped chamber at this point then the temperature within the compressor will fall to point 4, compression will then continue to point 5 to achieve the delivery pressure Pd. Desuperheating and condensing of the gas will then take place as shown by line to 5 to 6. In a non-economised system the liquid would pass through an expansion device where the pressure would be reduced to suction pressure Ps at point 10. However in an economised system some liquid is dropped in pressure to point 7 at the economiser pressure Pe where it boils off and cools the remaining liquid to point 8. FIG. 5 is drawn in respect of an open flooded economiser vessel but it is equally possible to accomplish this cooling in an indirect heat exchanger where the liquid that is cooled is retained at the higher condensing pressure. Finally the remaining liquid in the economiser is fed, via an expansion remaining liquid in the economiser is fed, via an expansion valve, to the evaporator, where it evaporates thus providing the required cooling and is ultimately returned to the compressor suction at point 1. Thus the beneficial effect of economising can be seen by the increased enthalpy change from 9 to 1 in the economised mode when compared to the enthalpy change from 10 to 1 as applies to a non-economised arrangement.

FIG. 6 shows the pressure enthalpy diagram for a simple scroll compressor system operating in accordance with the method of the invention. Starting at point 1, in a conventional system the compression process would normally progress along dashed line 1-4. However if the compression process is divided into two "C"-shaped compression chambers such that the first compression chamber compresses over the entire required pressure range from suction pressure to delivery pressure, whereas the second compression chamber compresses over a reduced compression ratio (and thus with higher efficiency and reduced temperature) from suction pressure Ps to the pressure Pe at the economiser port of the first chamber, as shown by line 1-3. The gas from this second "C"-shaped chamber is fed via the economiser port of the first chamber, into the first "C"-shaped chamber, where the two compression gas streams are combined. The compression process in the first chamber progresses along line 1-2, which is less efficient than that achieved in the second chamber due to the gas leakage effects from the higher pressure ultimately achieved in this compression chamber. The combined gas streams will then be further compressed in the first compression chamber to the final delivery pressure Pd at point 5. The cycle continues with desuperheating and condensing taking place between 5 and 6, the pressure then being dropped from 6 to 7 and the liquid boiled off in the evaporator from 7 to 1. In this instance the benefits are not shown by an increase in enthalpy change in the evaporator, but rather by an increase in mass flow through the evaporator together with an improvement in coefficient of performance (C.O.P.), which can not be represented in FIG. 6.

FIG. 7 also shows a further scroll compressor system operating in the manner of the invention, but with the addition of economising of the low compression ratio chamber. In this instance the two gas flows are combined in the first "C"-shaped compression chamber from points 2 and 3, like the non-economised arrangement discussed above and compressed together to the final delivery pressure Pd at point 5. However the second "C"-shaped compression chamber combines the economising effect described previously. Thus desuperheating and condensing of the gas takes place between 5 and 6. The liquid is then dropped in pressure to Pel at point 7 in the economiser vessel, where some liquid is boiled off and returned to the economiser port of the second compression chamber. This evaporation cools the remaining liquid in the economiser to point 8. Finally the remaining liquid in the economiser is fed to the evaporator, where it evaporates, thus providing the required cooling and is ultimately returned from point 9 to the compressor suction at point 1. FIG. 7 again shows an open-flooded economiser vessel but it is equally possible to accomplish this economiser liquid cooling in an indirect heat exchanger where the liquid that is cooled is retained at the higher condensing pressure. In this instance the beneficial effect of economising can be seen by the increase in enthalpy change in the evaporator shown by line 9-1 in this diagram when compared with line 7-1 of FIG. 6.

FIG. 8 shows another economised system operating in accordance with the method of the invention as shown in FIG. 7, but with the addition of means for providing economising to the first "C"-shaped compression chamber. This system operates similarly to that previously described (for FIG. 7) except that after the gas from the second "C"-shaped compression chamber has been fed to the first compression camber further economising is introduced in one of two possible ways. Either additional high pressure economiser flow is also introduced at the pressure where the two compression chambers are combined, from an additional economiser vessel, or alternatively economiser flow from the second high pressure economiser operating at pressure Pem is introduced at a later stage either by pressure regulation or an additional later economiser port into the first compression chamber. In this instance the beneficial effect of additional economising can be seen by the increase in enthalpy change in the evaporator shown by line 12-1 in this diagram when compared with 9-1 of FIG. 7.

In all four cases shown in FIGS. 5 to 8, the beneficial effect on power can be seen by either a reduction in the enthalpy at the end of the compression process or by a reduced pressure difference over which any gas flow is required to be compressed.

Prior art design single stage multi-scroll compressor systems combine the delivery ports from each of the scroll compressors into a common delivery line while the suction ports of the compressors are connected to a common suction line. In a modification according to the invention, the suction line remains open to the suction ports of all the scroll compressors but the delivery ports of at least two of the compressors are not separated. In the case of only two compressors, the first compressor can be piped up externally in the conventional fashion with the delivery connected to the condenser. However delivery gas from the second scroll compressor is taken to an economiser port provided on the first scroll compressor (the conventionally connected scroll compressor). If required, the economiser connection of the second scroll compressor may be used to provide a conventional economiser facility.

Unloading of scroll compressors connected in this way can be accomplished in the normal manner by unloading both compressor processes together. However, for efficient part-load operation the compression process pumping into the economiser port should be unloaded first, followed by unloading of the remaining compression process.

The economiser ports are not required to be located in fixed positions on the compressor casing; rather, the ports can be provided such that their location on the casing is adjustable to ensure that an optimum part-load economiser position is obtained.

Figure 9:
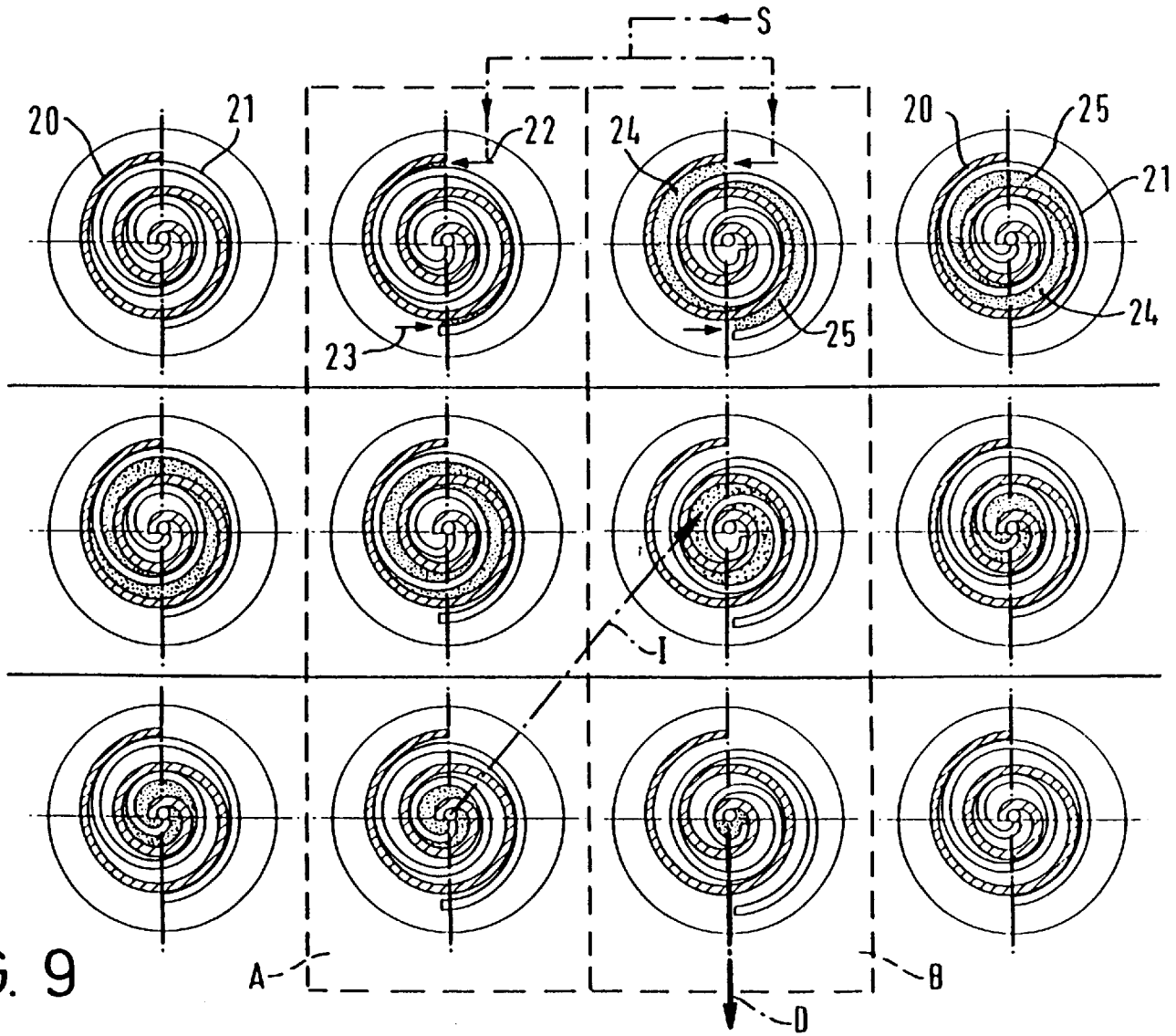
FIG. 9 is a series of schematic views of the two intermeshed scrolls of a scroll compressor throughout three orbits, the upper four views showing the opening of a chamber to suction, the middle four views showing the closing and subsequent reduction in volume of two "C"-shaped pumping chambers during compression and the lower four views showing the disappearance of the two chambers during discharge.

FIG. 9 shows twelve views of the intermeshing scrolls which create the pumping chambers of a scroll compressor, the stationary scroll being shown cross hatched at 20 and the orbiting scroll being shown unshaded at 21.

Altogether, the twelve views represent three complete orbits of the two scrolls, one relative to the other, the four views in the upper row representing positions 90° apart during the first orbit, the second row representing four positions 90° apart during the second orbit and the bottom row, scroll positions at 90° intervals during the third orbit. It will be noted that with the inlet of the compressor opening to the outer periphery of the scrolls 20, 21, there is no chamber available for filling with gas from the inlet in the first view in the top row but that two such chambers do begin to open between the first and the second views in the upper row. The arrows 22, 23 at the top and bottom of the second and third views in the upper row indicate gas at inlet pressure flowing into expanding chambers 24, 25. (Shown dotted)

The third view in the upper row shows the development of two "C"-shaped chambers 24, 25 which continue to expand and fill with gas from the inlet, whereas the last view in the upper row shows these chambers at maximum volume but now closed against further ingress of gas at inlet pressure. During the second orbit (i.e. considering the views in the middle row), the two "C"-shaped chambers 24, 25 reduce in size as the orbital motion between the scrolls causes these pumping chambers to spiral in towards the centre of the stationary scroll 20. The lowest row shows stages during the third orbit when the two chambers reach their minimum volume and discharge their compressed contents to the outlet of the compressor located in the center of the stationary scroll.

From the above description it will be appreciated that suction, compression and discharge are performed simultaneously as a natural consequence of the orbiting motion of the intermeshed scrolls. Although three orbits have been illustrated to complete the process, it is possible to operate a scroll compressor with more or less than three orbits, if required.

In accordance with the method of the invention it is necessary to provide an inter-connection between an outlet port of one pumping chamber to an intermediate port of another pumping chamber which has closed off from the inlet. This inter-connection is schematically demonstrated by the dashed lines in FIG. 9 involving the middle two columns of the three rows of views. If it is assumed that the block designated A in FIG. 9 represents a first scroll compressor and the block designated B represents a second scroll compressor, the chain line S feeding both opening pumping chambers represents a common suction duct to compressors A and B and the outlet chain line D shown from compressor B represents the discharge of the scroll compressor arrangement. The invention is primarily concerned with the provision of the interconnection represented by chain line I which takes gas compressed in compressor A and feeds it to either or both closed pumping chambers in compressor B.

In order to extend the range of commercially available scroll compressors it is known to supply a pair of such compressors, as a single tandem unit. The compressors of such a unit are supplied each in its own hermetically sealed casing, mounted on a common support plate with the two suction ports connected in parallel to a common suction duct for the pair and the two exhaust ports connected to a common exhaust duct. Economiser ports to each scroll compressor of the pair would be separately accessible. Thus to operate such a ganged-pair of scroll compressors in accordance with the method of this invention simple reconnection of exhaust ports is required so that the exhaust duct leads only from the exhaust port of one of the compressors, the exhaust port of the other compressor being connected to the economiser port of the said one compressor. With this arrangement there are four C-shaped chambers provided by the unit.

Where chambers 24 and 25 can be isolated from each other during the compression process so that the discharge of gas at pressure Pe from one chamber can be fed to the economiser port of the other chamber, the invention could be practiced with just two C-shaped chambers.

Suitably the pressure Pe shown in FIGS. 6 to 8 is in the range 30% to 70% of Pd, the delivery pressure from the compressor.

By providing non-return valves between the discharge ports 13*a* and 13*b,* together with an (automatic or manual) isolating valve between 13*a* and 12*b,* the compressor arrangement can be switched between standard operation and operation in accordance with this invention.

One of the applicants also has co-pending applications of even date which describe the application of supercharging as described herein to a single screw compressor and to compressor arrangements for applying supercharging as described herein to reciprocal, single and twin-screw compressors and/or combinations thereof.

What is claimed is:

1. A gas compressor comprising:

at least two "C"-shaped pumping chambers each having a variable volume up to a maximum volume, each of said pumping chambers having a primary inlet for receiving a fluid to be compressed when said volume of said respective pumping chamber equals a first volume which is at least close to said maximum volume of said respective pumping chamber, and each of said pumping chambers having an outlet for discharging compressed fluid when said volume of said respective pumping chamber equals a second volume which is less than said first volume, one of said pumping chambers having a secondary inlet which opens to said one pumping chamber when said volume of said one pumping chamber is equal to a third volume intermediate said first and second volumes after said one pumping chamber is closed off from said primary inlet of said one pumping chamber but before said outlet of said one pumping chamber opens, and said outlet of the other of said pumping chambers being connected in direct fluid communication to said secondary inlet of said one pumping chamber.

2. A gas compressor according to claim 1, wherein said chambers are provided in a common casing.

3. A gas compressor according to claim 1, wherein each of said chambers is formed in a separate scroll compressor.

4. A method of improving the efficiency of a pair of first and second scroll refrigeration compressors, comprising the steps of:

providing a second scroll refrigeration compressor which includes a primary inlet for admitting fluid at an inlet pressure, an intermediate port, and an outlet for discharging fluid at a delivery pressure, and delivering the discharge of a first scroll compressor into the intermediate port of the second scroll compressor at a pressure higher than said inlet pressure and lower than said delivery pressure of said second scroll compressor.

5. A method according to claim 4, wherein said discharge of the first scroll compressor is at a pressure in a range 30% to 70% of the delivery pressure of the second scroll compressor.

6. A gas compressor for receiving, compressing and discharging a fluid, comprising:

a first and a second "C"-shaped pumping chamber each having a primary inlet for receiving fluid to be compressed, an outlet for discharging fluid in a compressed state, and a volume variable between at least a first defined volume which is substantially equal to a maximum chamber volume and a second defined volume which is less than said first defined volume, each of said first and second chambers receiving fluid when its respective volume equals said first defined volume and each of said first and second chambers discharging fluid in a compressed state when its respective volume equals said second defined volume; and said first chamber having a secondary inlet which is in direct communication with said outlet of said second chamber and which permits fluid in a compressed state discharged by said outlet of said second chamber to be fed directly into said first chamber when said volume of said first chamber is equal to a third defined volume intermediate to said first and second defined volumes and when said primary inlet and said outlet of said first chamber are closed.

7. A gas compressor according to claim 6, wherein said first C-shaped chamber is formed in a first scroll compressor, and wherein said second C-shaped chamber is formed in a second scroll compressor separate from said first scroll compressor.

8. A gas compressor according to claim 7, wherein said first and second chambers are provided in a common casing.

9. A method of improving the efficiency of a pair of first and second scroll refrigeration compressors, comprising the steps of:

arranging a first scroll refrigeration compressor relative to a second scroll refrigeration compressor, said first scroll refrigeration compressor having an outlet for discharging a compressed fluid and said second scroll refrigeration compressor having a primary inlet admitting fluid at an inlet pressure, an intermediate port, and a delivery outlet discharging fluid at a delivery pressure; and delivering said compressed fluid discharged via said outlet of said first scroll refrigeration compressor into said intermediate port of said second scroll refrigeration compressor at a pressure higher than said inlet pressure and lower than said delivery pressure of said second scroll refrigeration compressor.

10. A method according to claim 9, wherein said compressed fluid discharged by said outlet of said first scroll refrigeration compressor is at a pressure within a range of about 30% to 70% of said delivery pressure of said second scroll refrigeration compressor.

* * * * *